US008295749B2

(12) United States Patent
Kerxhalli et al.

(10) Patent No.: US 8,295,749 B2
(45) Date of Patent: Oct. 23, 2012

(54) METHOD AND APPARATUS FOR PRINTING VARIOUS SHEET SIZES WITHIN A PITCH MODE IN A DIGITAL PRINTING SYSTEM

(75) Inventors: David Mark Kerxhalli, Rochester, NY (US); David Robert Kretschmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 51 days.

(21) Appl. No.: 12/792,010

(22) Filed: Jun. 2, 2010

(65) Prior Publication Data

US 2011/0299889 A1 Dec. 8, 2011

(51) Int. Cl.
*G03G 15/22* (2006.01)
*G03G 15/00* (2006.01)

(52) U.S. Cl. ..... 399/306; 399/43; 399/45; 399/163; 399/303; 399/312

(58) Field of Classification Search ..... 399/8, 14, 399/43, 45, 160, 162, 163, 167, 169, 599, 399/302, 303, 306, 308, 312, 313
See application file for complete search history.

(56) References Cited

U.S. PATENT DOCUMENTS

| | | | | |
|---|---|---|---|---|
| 2003/0077095 | A1* | 4/2003 | Conrow | 399/364 |
| 2004/0076450 | A1 | 4/2004 | Martin et al. | |
| 2004/0221942 | A1 | 11/2004 | Yu et al. | |
| 2006/0233569 | A1* | 10/2006 | Furst et al. | 399/162 |
| 2008/0089703 | A1 | 4/2008 | Calamita | |
| 2008/0260445 | A1 | 10/2008 | Costanza et al. | |
| 2010/0020364 | A1 | 1/2010 | Kerxhalli et al. | |
| 2010/0209161 | A1 | 8/2010 | Tooker et al. | |

* cited by examiner

*Primary Examiner* — Walter L Lindsay, Jr.
*Assistant Examiner* — Jessica L Eley
(74) *Attorney, Agent, or Firm* — Fay Sharpe LLP

(57) ABSTRACT

A method of controlling the inverter dwell time of the first print engine in order to print any sheet size within a pitch mode without the need for a belt sync dead-cycle. The method uses a small nominal inverter dwell time based on the maximum sheet size for a given pitch mode. For any sheet size within the pitch mode that is smaller than the maximum sheet size, the inverter dwell time will increase proportionally.

17 Claims, 3 Drawing Sheets

METHOD AND APPARATUS FOR PRINTING VARIOUS SHEET SIZES WITHIN A PITCH MODE IN A DIGITAL PRINTING SYSTEM

BACKGROUND

The present disclosure relates to digital printing systems having plural tandem print or printing engines of the type with seamed endless photoreceptor belts.

By way of background, in a typical electrophotographic printing machine a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, bringing a developer material into contact therewith develops the latent image. Generally, the electrostatic latent image is developed with dry developer material comprising carrier granules having toner particles adhering triboelectrically thereto. However, a liquid developer material may be used as well. The toner particles are attracted to the latent image, forming a visible powder image on the photoconductive surface. After the electrostatic latent image is developed with the toner particles, the toner powder image is transferred to copy media. Thereafter, the toner image is heated to permanently fuse it to the copy media.

It is highly desirable to use a photoconductive member of this type in an electrophotographic printing machine to produce color prints. In order to produce a color print, the printing machine includes a plurality of stations. Each station has a charging device for charging the photoconductive surface, an exposing device for selectively illuminating the charged portions of the photoconductive surface to record an electrostatic latent image thereon, and a developer unit for developing the electrostatic latent image with toner particles. Each developer unit deposits different color toner particles on the respective electrostatic latent image. The images are developed, at least partially in superimposed registration with one another, to form a multi-color toner powder image. The resultant multi-color powder image is subsequently transferred to a sheet. The transferred multi-color image is then permanently fused to the sheet forming the color print.

Electrophotographic printing machines to date use a photoconductive member that is a seamed belt coated with a photoconductive material. Images are laid down on the belt such that an interdocument zone follows the image area, and since the seamed area of the belt results in an image quality defect, the seam area of the belt is kept within an interdocument area. Thus, the interdocument zones are limited to receiving latent process control patches that enable the electrophotographic process to be monitored and controlled.

In tandem printing systems, it is common practice to invert the sheet after print on one side thereof in a first of the print engines and for feeding the inverted sheet into a second print engine for print on the opposite side of the sheet to thus facilitate high speed duplex digital printing. However, in printing systems of this type arrangement, problems have been encountered in proper registration of the leading edge of the inverted sheet onto the photoreceptor of the second printing engine for proper placement of the image on the sheet and for avoiding the seam in the photoreceptor of the second print engine. Where the inverted sheet from the first print engine is transported by a transporter to the second print engine, errors in timing, transport speed and positioning of the sheet can accumulate to cause misregistration of the sheet on the second photoreceptor. This is particularly troublesome in view of the requirement that the sheet be placed on the second photoreceptor within a window of plus or minus 30 milliseconds timing with respect to the movement of the photoreceptor. Typically, tandem print engines employed for duplex printing operate to synchronize the position of the seams by varying the speed of the photoreceptor in the second print engine and can result in problems with front to back image-to-paper registration due to paper shrinkage from heating in the first print engine's fuser and differences in the photoreceptor belt length causing varied photoreceptor speed.

Digital printing systems employing tandem print engines for duplex printing have operated in accordance with a procedure wherein the system schedules the arrival times of the sheet stock in the initial and subsequent print engines and proceeds to have the feeder eject the sheet stock to meet the scheduled arrival time. The sheet then arrives at the entrance of the first print engine and is registered thereon for upper registration for print. The sheet is registered for image transfer from the photoreceptor belt and arrives at the discharge exit at the first print engine. The system then submits the sheet stock to the inverter, which discharges the sheet stock after a fixed dwell time.

Thus, it has been desired to provide a way of improving the registration of the leading edge of sheets emanating from a first tandem print engine onto the second print engine.

In a tandem print engine using seamed photoreceptor belts (or seamed intermediate transfer belts), there now exists a belt sync routine that adjusts the speed of the belt in print engine 2 so that the period of belt 2 is equal to the period of belt 1 in print engine 1. The seam of belt 2 is held in a constant phase offset (seam offset) with the seam of belt 1. This seam offset is chosen so that the media traveling through the media path will arrive at the transfer of print engine 1 and print engine 2 at the appropriate time—so that the sheet lead edge will meet the appropriate image panel on each belt. A new seam offset would need to be calculated for every sheet size, which requires another belt sync. Since the belt sync routine requires dead-cycling over multiple belt revolutions, this would have a significant productivity impact for customers running jobs with multiple sheet sizes.

Thus, the exemplary embodiments relate to a new and improved method and apparatus that resolves the above-referenced difficulties and others.

INCORPORATION BY REFERENCE

The following patents/applications, the disclosures of each being totally incorporated herein by reference, are mentioned:

U.S. application Ser. No. 12/060,427, filed Feb. 18, 2009 and entitled CONTROLLING SHEET REGISTRATION IN A DIGITAL PRINTING SYSTEM;

U.S. Patent Publication No. 2008/0260445, published Oct. 23, 2008 and entitled METHOD OF CONTROLLING AUTOMATIC ELECTROSTATIC MEDIA SHEET PRINTING.

BRIEF DESCRIPTION

The exemplary method controls the inverter dwell time of the first print engine in order to print any sheet size within a pitch mode without the need for a belt sync dead-cycle. The method uses a small nominal inverter dwell time based on the maximum sheet size for a given pitch mode. For any sheet size within the pitch mode that is smaller than the maximum sheet size, the inverter dwell time will increase proportionally. Modeling shows that there is enough allowable inverter dwell time to accommodate all sheet sizes within each pitch mode.

In one embodiment, a method of controlling image to print media sheet registration in a tandem digital printing system is provided The method includes: receiving a plurality of parameters for a print job; cycling up a first print engine and a second print engine, wherein the first print engine includes at least a first seamed photoreceptor belt and an output inverter and the second print engine includes at least a second seamed photoreceptor belt; calculating a seam offset for the first and second photoreceptor belts; adjusting the speed of the first and second photoreceptor belts based on the seam offset; starting the print job; and adjusting a dwell time of the output inverter on a sheet by sheet basis.

In another embodiment, a tandem digital printing system is provided. The system includes a first print engine having a first seamed photoreceptor belt and an output inverter, a second print engine having a first seamed photoreceptor belt, and a master controller operatively connected to the first and second print engines and the first inverter. Further, the master controller is operative to: receiving a plurality of parameters for a print job and then cycling up a first print engine and a second print engine, wherein the first print engine includes at least a first seamed photoreceptor belt and an output inverter and the second print engine includes at least a second seamed photoreceptor belt. Next, a seam offset for the first and second photoreceptor belts is calculated. The speed of the first and second photoreceptor belts is adjusted based on the seam offset, the print job is started the print job, and a dwell time of the output inverter is adjusted on a sheet by sheet basis.

In yet another embodiment, a computer program product is provided. The product comprises a computer-usable data carrier storing instructions that, when executed by a computer, cause the computer to perform a method comprising: receiving a plurality of parameters for a print job; cycling up a first print engine and a second print engine, wherein the first print engine includes at least a first seamed photoreceptor belt and an output inverter and the second print engine includes at least a second seamed photoreceptor belt; calculating a seam offset for the first and second photoreceptor belts; adjusting the speed of the first and second photoreceptor belts based on the seam offset; starting the print job; and adjusting a dwell time of the output inverter on a sheet by sheet basis.

DETAILED DESCRIPTION

As used herein, "print media" generally refers to a usually flimsy physical sheet of paper, plastic, or other suitable physical print media substrate for images, whether precut or web fed. A "print job" is normally a set of related sheets, usually one or more collated copy sets copied from a set of original document sheets or electronic document page images, from a particular user, or which are otherwise related.

The word "printer" and the term "printing system" as used herein encompass any apparatus and/or system, such as a digital copier, xerographic and reprographic printing systems, bookmaking machine, facsimile machine, multi-function machine, ink-jet machine, continuous feed, sheet-fed printing device, etc. which may contain a print controller and a print engine and which may perform a print outputting function for any purpose. The word "tool" as used herein may encompass hardware, software or a set of instructions for performing the system and method described herein.

Figure 1:
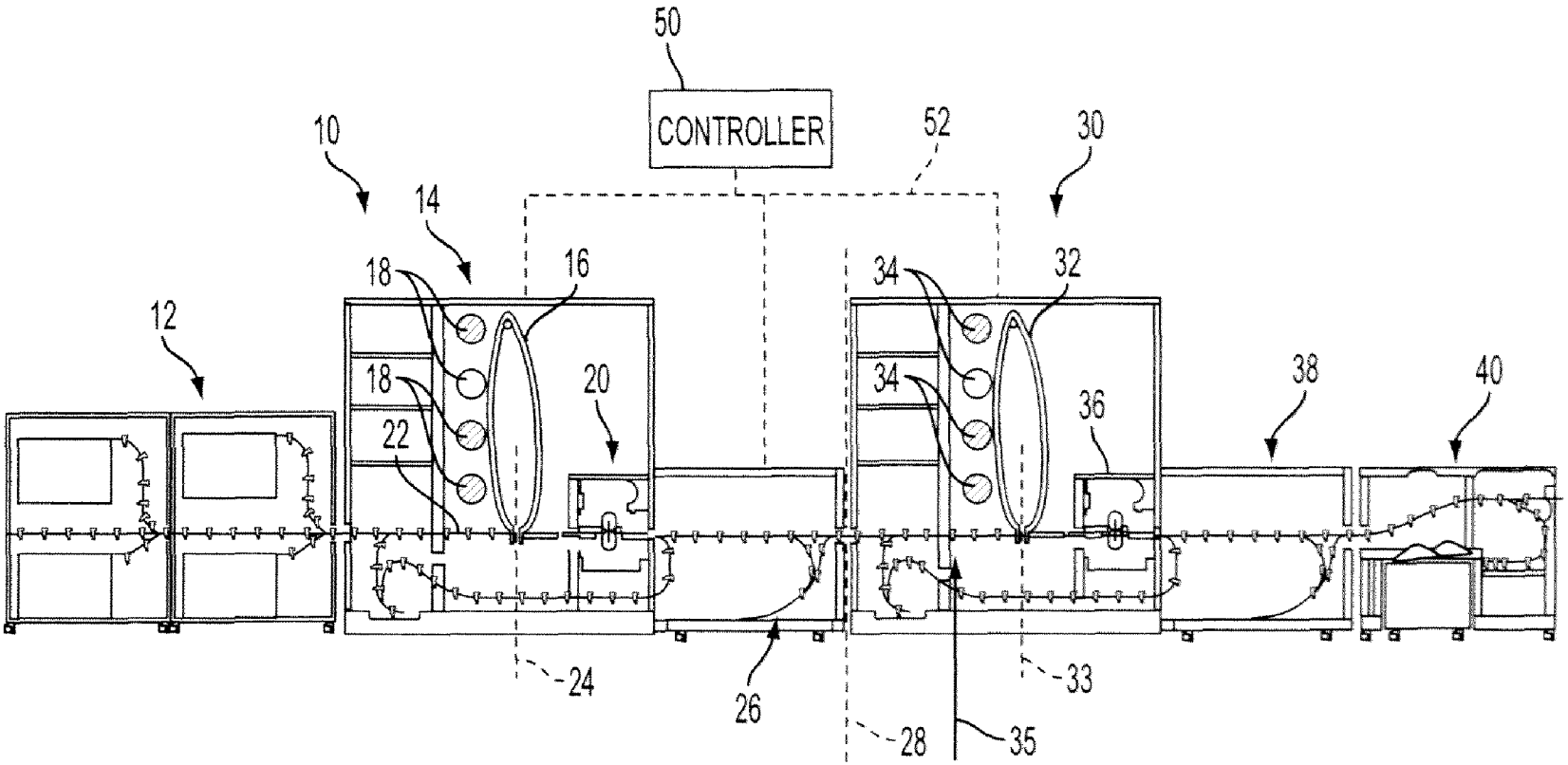
FIG. 1 is a schematic of a digital printing system having plural print engines in tandem, which incorporates aspects of the exemplary embodiments.

Referring to FIG. 1, an exemplary digital printing system 10 includes a sheet feeder assembly 12, a first print engine 14 including a first photoreceptor 16 of the endless seamed type and a first set of colorant generators 18 operative for effecting color image formation on the first photoreceptor belt 16. The first print engine 14 includes an initial fuser 20 and a transporter providing a first transport path 22 through the print first engine 14. The first photoreceptor belt 16 is operative to transfer the image to the sheet stock on the first transport path 22 at a first transfer station 24 (or Transfer 1) indicated in dashed outline.

From the printing at the first transfer station 24, the sheet stock is advanced along the first transport path 22 and is discharged from the fuser 20 along the first transport path 22 to a first inverter 26, which inverts the marked sheet and maintains the sheet for a controlled dwell time before reentry onto the first transport path 22 and movement to the entrance station 28 for the second print engine 30.

The sheet stock is controlled, as will hereinafter be described, to arrive at the registration point indicated by the arrow and denoted by reference numeral 35 in the second print engine 30 at a controlled time.

The second print engine 30 includes a second photoreceptor 32 of the seamed belt type and has a second set of colorant generators 34 disposed for forming a color image on the second photoreceptor 32. The second photoreceptor belt 32 is operative to transfer the color image to the second side of the sheet at a second transfer station 33 (Transfer 2) indicated in dashed outline. The second print engine 30 also includes a post-print fuser 36, the output from which the sheet is inputted to a second inverter 38, which restores the sheet to its original orientation and discharges the duplex marked sheet to a finisher 40.

The system 10 of FIG. 1 also includes a master controller 50, which is operatively connected as indicated by the dashed lines and controls the first and second print engines 14, 30 and the first inverter 26, as will hereinafter be described. Although not shown, it is to be understood that the master controller 50 may include computer components such as a central processing unit (CPU), memory storage devices for the CPU, and connected display and input devices, for running one or more computer programs. Such computer program(s) may be stored in a computer readable storage medium, such as, but is not limited to, flash drives, hard drives, floppy disks, optical disks, CD-ROMs, magnetic-optical disks, read-only memories (ROMs), random access memories (RAMs), EPROMs, EEPROMs, magnetic or optical cards, DVDs, or any type of media suitable for storing electronic instructions, and each coupled to a computer system bus.

One skilled in the art will appreciate that while the multicolor developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Figure 2:
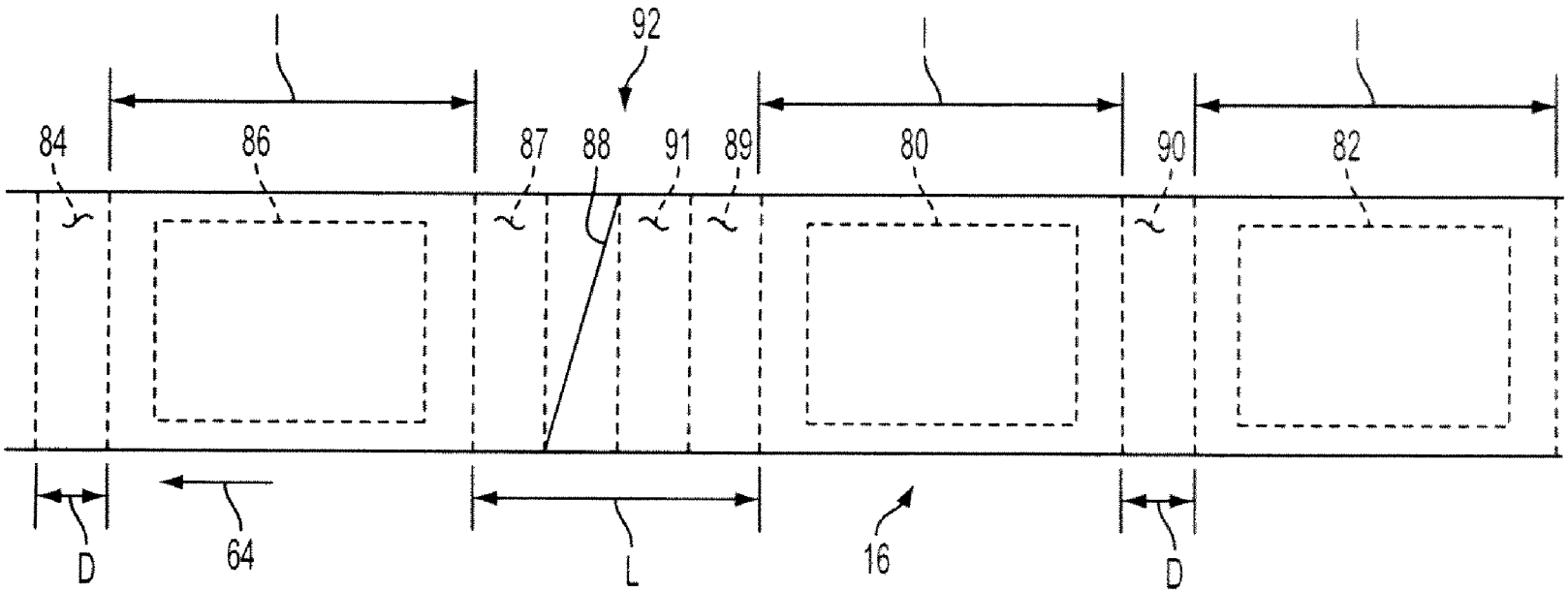
FIG. 2 is a schematic view of a partial layout for an 11 pitch photoconductive member, which incorporates the principles of the exemplary embodiments.

FIG. 2 illustrates a partial schematic view of an 11 pitch photoconductive member (or belt) such as the photoreceptor belt 16 of FIG. 1. As the photoconductive member 16 travels in the direction of arrow 64, each part of it passes through the subsequently described process stations shown in FIG. 1. For convenience, sections of the photoconductive member 16 are identified. An image area is the part of the photoconductive member 16 that is to be exposed and developed to produce a composite image. Likewise, an interdocument zone is limited to receiving latent process control patches that enable the electrophotographic process to be monitored and controlled.

It is to be understood that photoconductive member 16 may include more than one image area. For example, FIG. 2 shows photoconductive member 16 having a first image area 80, a second image area 82, and an eleventh (last) image area 86 all of a constant length I. Images are laid down on the belt 16 such that an interdocument zone follows an image area. For example the image area 80 is followed by an interdocument zone 90, and the tenth image area (not shown) is followed by an interdocument zone 84. Even if the photoconductive belt 16 has only four image areas, for example instead of eleven, it still has interdocument areas separating the lead and trail edges of the images. There will be an equal number of interdocument zones as image areas.

Since the seamed area of the photoconductive belt 16 results in an image quality defect, the seam area of the belt is also kept within an interdocument zone. An interdocument zone 92 not only includes a belt seam 88, but contains a No Write Zone 87 at the lead edge of the seam 88, a No Write Zone 91 at the trail edge of the seam 88, and a zone 89 where patches can be written and measured such as an Image-On-Image (I-O-I) registration zone. As shown in FIG. 2, the interdocument zone is a length L that is considerably longer than the constant length D of the other interdocument zones I laid out on the photoconductive member 16.

It is to be understood that the second photoreceptor belt 32 of FIG. 1 is generally configured in a similar fashion.

Photoreceptor synchronization first sets the speed of the second photoreceptor belt 32 of the second print engine 30 so that its period is the same as the period of the first photoreceptor belt, and then sets the position of the seam zone of the second photoreceptor belt 32. The exemplary method runs at cycle-up and positions the seam of the second photoreceptor relative to the first photoreceptor and keeps its speed at the target defined by the Image On Paper (IOP) Registration Setup. This machine setup adjusts parameters so that the image is accurately located on the sheet. One of the adjustments in this setup is PR Belt Speed, which adjusts Process Magnification.

The system 10 utilizes a control line 52 to synchronize the photoreceptor belt (PR) speeds between the first and second print engines (14, 30). This control line 52 sends the seam hole signal from the PRBC (Photoreceptor Belt Controller) (not shown) in the first print engine 14 to the PRBC (not shown) in the second print engine 30, adjusting the velocity of the second photoreceptor 32 in the second print engine 30 and adjusting the seam-to-seam offset distance (seam offset). The seam offset is set so that the sheet lead edge arrives at each print engine at the appropriate time. Currently, this seam offset must change if the sheet size changes because the time for the sheet to travel from the first print engine 14 to the second print engine 30 changes with sheet size. Changing the seam offset requires the print engine to suspend printing and run the belt sync routine, which impacts productivity for the customer. The exemplary method uses the inverter dwell time to keep the total sheet time from first print engine 14 to the second print engine 30 constant for all sheet sizes within a pitch mode, where "pitch" defines a sheet length (or width) plus the distance between the end of one sheet and the beginning of another sheet to be processed. The "pitch mode" is generally defined in the print engine software by the incoming sheet length. The software attempts to maximize the number of image panels around a revolution of the photoreceptor belt. If the sheet length is greater than the max sheet size for a given pitch mode, then the machine will configure to the next lower pitch mode (allowing fewer images around the belt. This allows the print engines to continue printing without the need for changing the seam offset, thus avoiding a dead-cycle for belt sync.

Figure 3:
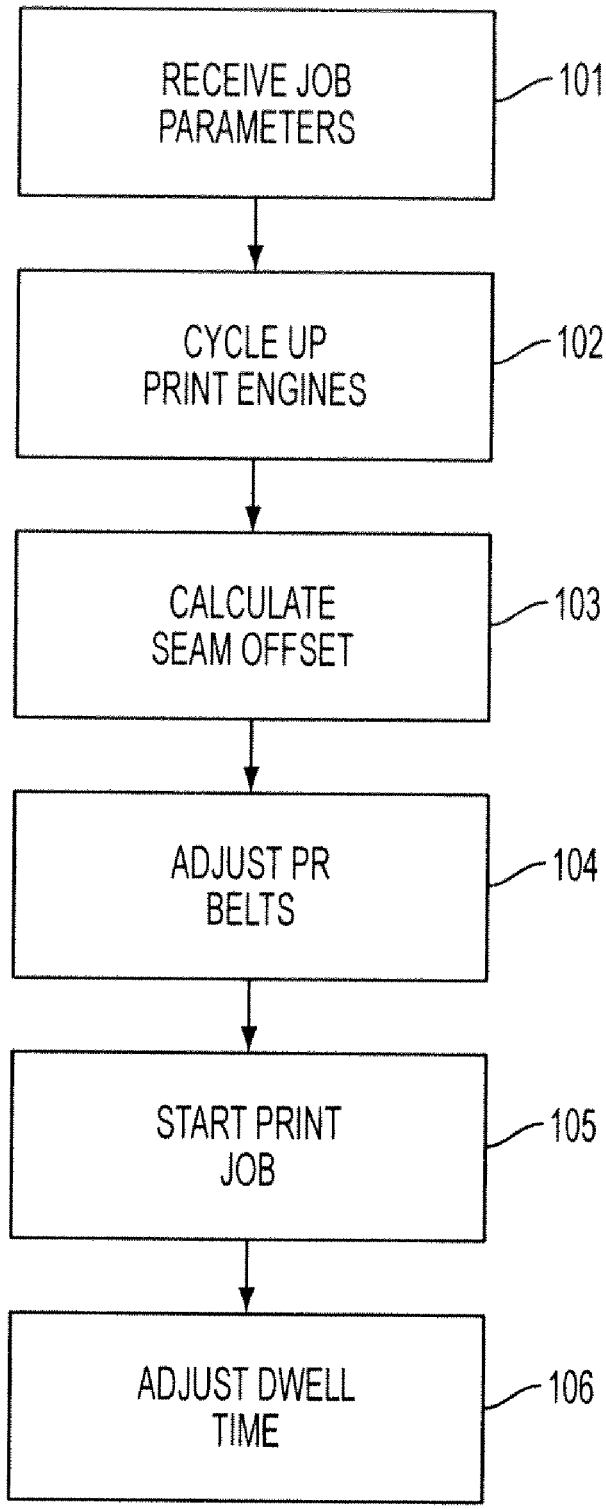
FIG. 3 is a flow diagram of an exemplary method of sheet transport control in the system of FIG. 1.

The exemplary method is illustrated in FIG. 3. With reference to FIG. 3, the master controller 50 receives the parameters for the print job (101). Next, the first and second print engines 14, 30 cycle up (102). At this point, the seam offset is calculated (103), as described more fully below. The speeds of the first and second photoreceptor belts 16, 33 are then adjusted based on the seam offset (104). The print job is then started (105). The output inverter 26 adjusts the inverter dwell time on a sheet-by-sheet basis, as described more fully below (106). This final step in the process refers to the calculation of the "Actual Inverter Dwell Time" as described more fully below.

The "Seam Offset" for the maximum sheet size in a given pitch mode can be calculated using a small nominal inverter dwell time from the following equation:

$$\text{SeamOffset}=\text{TimeFromXfer1toInverterHoldMaxSheetSize}+\text{NomInverterDwellTime}+\text{TimeFromInverterHoldtoXfer2}-\text{BeltPeriod} \quad (1)$$

Where:

SeamOffset=the amount of time to offset the seam of the second photoreceptor belt 32 relative to the seam of the first photoreceptor belt 16. This will change based on pitch mode, since TimeFromXfer1toInverterHoldMaxSheetSize changes with Pitch Mode.

TimeFromXfer1toInverterHoldMaxSheetSize=the time from the first print engine transfer until the sheet is stopped in the output inverter 26 of the first print engine 14 for the maximum sheet size in the given pitch mode.

NomInverterDwellTime=the nominal dwell time in the output inverter of the first print engine 14. This time should be biased to the shorter side of the total allowable dwell time window, so that the "Actual Inverter Dwell Time" (see below) can be increased as the sheet size decreases within the pitch mode.

TimeFromInverterHoldtoXfer2=the time from when the sheet begins to exit the inverter 26 until the sheet arrives at the second print engine transfer 33 for the maximum sheet size in the given pitch mode.

BeltPeriod=the time for one revolution of the PR Belt (or Intermediate Transfer Belt). The belt sync routine holds the period of the second belt 32 equal to the period of the first belt 16, so it does not matter which one is used in this equation.

The "Actual Inverter Dwell Time" may be calculated from the following equation:

$$\text{ActualInverterDwellTime}=\text{NomInverterDwellTime}+(\text{MaxSheetSize}-\text{ActualSheetSize})/\text{InputSpeed} \quad (2)$$

Where:

ActualInverterDwellTime=the amount of time to hold the sheet in the output inverter of the first print engine 14 for a given sheet size and pitch mode.

NomInverterDwellTime=the nominal dwell time in the output inverter of the first print engine 14. This time is generally biased to the shorter side of the total allowable dwell time window so that the ActualInverterDwellTime can increase as the sheet size decreases within the Pitch Mode. Note that for a Pitch Mode there is a calculated amount of max time that the sheet is allowed to dwell in the inverter before the next incoming sheet will crash into the sheet being held. The equation is a function of inverter input/output speeds, inverter deceleration, inverter acceleration, sheet length, and Pitch Mode.

MaxSheetSize=the maximum sheet size for a given pitch mode.

ActualSheetSize=the actual sheet size for the sheet entering the output inverter of the first print engine 14.

InputSpeed=the speed of the sheet entering the output inverter 26 of the first print engine 14.

Thus, the exemplary method varies the hold time of the output inverter 26 of the first print engine 14 to allow the machine to print various sheet sizes within a pitch mode at full productivity. One benefit is improved productivity for jobs with variable sheet sizes in the same pitch mode and streamed jobs of different sheet sizes within the same pitch mode.

The method illustrated in FIG. 3 may be implemented in a computer program product that may be executed on a computing device. The computer program product may be a tangible computer-readable recording medium on which a control program is recorded, such as a disk, hard drive, or may be a transmittable carrier wave in which the control program is embodied as a data signal. Common forms of computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, transmission media, such as acoustic or light waves, such as those generated during radio wave and infrared data communications, and the like, or any other medium from which a computer can read and use.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of controlling image to print media sheet registration in a tandem digital printing system, the method comprising:

receiving a plurality of parameters for a print job;

cycling up a first print engine and a second print engine, wherein the first print engine includes at least a first seamed photoreceptor belt and an output inverter and the second print engine includes at least a second seamed photoreceptor belt;

calculating a seam offset for the first and second photoreceptor belts, wherein the seam offset comprises an amount of time to offset the seam of the second photoreceptor belt relative to the seam of the first photoreceptor belt;

adjusting the speed of the second photoreceptor belt based on the seam offset;

starting the print job; and adjusting a dwell time of the output inverter for a given sheet length based on a maximum sheet size for a given pitch mode, actual sheet size, and the speed of the sheet entering the output inverter.

2. The method of claim 1, wherein the seam offset for a maximum sheet size in a given pitch mode is calculated as follows:

$$\text{SeamOffset}=\text{TimeFromXfer1toInverterHoldMaxSheetSize}+\text{NomInverterDwellTime}+\text{TimeFromInverterHoldtoXfer2}-\text{BeltPeriod}$$

Where:

TimeFromXfer1toInverterHoldMaxSheetSize=the time from the first print engine transfer until the sheet is stopped in the output inverter of the first print engine for the maximum sheet size in the given pitch mode;

NomInverterDwellTime=the nominal dwell time in the output inverter of the first print engine;

TimeFromInverterHoldtoXfer2=the time from when the sheet begins to exit the inverter until the sheet arrives at the second print engine transfer for the maximum sheet size in the given pitch mode;

BeltPeriod=the time for one revolution of the photoreceptor belts.

3. The method of claim 2, wherein the dwell time is biased to a shorter side of a total allowable dwell time window and an Actual Inverter Dwell Time can be increased as the sheet size decreases within a pitch mode.

4. The method of claim 3, wherein The Actual Inverter Dwell Time comprises the amount of time to hold the sheet in the output inverter of the first print engine for a given sheet size and pitch mode.

5. The method of claim 3, wherein The Actual Inverter Dwell Time is calculated as follows:

$$\text{ActualInverterDwellTime}=\text{NomInverterDwellTime}+(\text{MaxSheetSize}-\text{ActualSheetSize})/\text{InputSpeed}$$

Where:

NomInverterDwellTime=the nominal dwell time in the output inverter of the first print engine;

MaxSheetSize=the maximum sheet size for a given pitch mode;

ActualSheetSize=the actual sheet size for the sheet entering the output inverter of the first print engine;

InputSpeed=the speed of the sheet entering the output inverter of the first print engine.

6. A tandem digital printing system comprising:

a first print engine having a first seamed photoreceptor belt and an output inverter;

a second print engine having a first seamed photoreceptor belt; and a master controller operatively connected to the first and second print engines and the first inverter, wherein the master controller is operative to:

receive a plurality of parameters for a print job;

cycle up a first print engine and a second print engine, wherein the first print engine includes at least a first seamed photoreceptor belt and an output inverter and the second print engine includes at least a second seamed photoreceptor belt;

calculate a seam offset for the first and second photoreceptor belts, wherein the seam offset comprises an amount of time to offset the seam of the second photoreceptor belt relative to the seam of the first photoreceptor belt;

adjust the speed of the second photoreceptor belt based on the seam offset;

start the print job; and adjust a dwell time of the output inverter for a given sheet length based on a maximum sheet size for a given pitch mode, actual sheet size, and the speed of the sheet entering the output inverter.

7. The system of claim 6, wherein the controller is further operative to calculate the seam offset for a maximum sheet size in a given pitch mode and wherein the seam offset is calculated as follows:

SeamOffset=TimeFromXfer1toInverterHoldMaxSheetSize+NomInverterDwellTime+TimeFromInverter-HoldtoXfer2−BeltPeriod Where:

TimeFromXfer1toInverterHoldMaxSheetSize=the time from the first print engine transfer until the sheet is stopped in the output inverter of the first print engine for the maximum sheet size in the given pitch mode;

NomInverterDwellTime=the nominal dwell time in the output inverter of the first print engine;

TimeFromInverterHoldtoXfer2=the time from when the sheet begins to exit the inverter until the sheet arrives at the second print engine transfer for the maximum sheet size in the given pitch mode;

BeltPeriod=the time for one revolution of the photoreceptor belts.

8. The system of claim 7, wherein the dwell time is biased to a shorter side of a total allowable dwell time window and an Actual Inverter Dwell Time can be increased as the sheet size decreases within a pitch mode.

9. The system of claim 8, wherein The Actual Inverter Dwell Time comprises the amount of time to hold the sheet in the output inverter of the first print engine for a given sheet size and pitch mode.

10. The system of claim 9, wherein the controller is further operative to calculate The Actual Inverter Dwell Time as follows:

ActualInverterDwellTime=NomInverterDwellTime+(MaxSheetSize−ActualSheetSize)/InputSpeed Where:

NomInverterDwellTime=the nominal dwell time in the output inverter of the first print engine;

MaxSheetSize=the maximum sheet size for a given pitch mode;

ActualSheetSize=the actual sheet size for the sheet entering the output inverter of the first print engine;

InputSpeed=the speed of the sheet entering the output inverter of the first print engine.

11. A computer program product comprising:

a computer-usable data carrier storing instructions that, when executed by a computer, cause the computer to perform a method comprising:

receiving a plurality of parameters for a print job;

cycling up a first print engine and a second print engine, wherein the first print engine includes at least a first seamed photoreceptor belt and an output inverter and the second print engine includes at least a second seamed photoreceptor belt;

calculating a seam offset for the first and second photoreceptor belts, wherein the seam offset comprises an amount of time to offset the seam of the second photoreceptor belt relative to the seam of the first photoreceptor belt;

adjusting the speed of the second photoreceptor belt based on the seam offset;

starting the print job; and adjusting a dwell time of the output inverter for a given sheet length based on a maximum sheet size for a given pitch mode, actual sheet size, and the speed of the sheet entering the output inverter.

12. The product of claim 11, wherein the seam offset for a maximum sheet size in a given pitch mode is calculated as follows:

SeamOffset=TimeFromXfer1toInverterHoldMaxSheetSize+NomInverterDwellTime+TimeFromInverter-HoldtoXfer2−BeltPeriod Where:

TimeFromXfer1toInverterHoldMaxSheetSize=the time from the first print engine transfer until the sheet is stopped in the output inverter of the first print engine for the maximum sheet size in the given pitch mode;

NomInverterDwellTime=the nominal dwell time in the output inverter of the first print engine;

TimeFromInverterHoldtoXfer2=the time from when the sheet begins to exit the inverter until the sheet arrives at the second print engine transfer for the maximum sheet size in the given pitch mode;

BeltPeriod=the time for one revolution of the photoreceptor belts.

13. The product of claim 12, wherein the dwell time is biased to a shorter side of a total allowable dwell time window and an Actual Inverter Dwell Time can be increased as the sheet size decreases within a pitch mode.

14. The product of claim 13, wherein The Actual Inverter Dwell Time comprises the amount of time to hold the sheet in the output inverter of the first print engine for a given sheet size and pitch mode.

15. The product of claim 14, wherein The Actual Inverter Dwell Time is calculated as follows:

ActualInverterDwellTime=NomInverterDwellTime+(MaxSheetSize−ActualSheetSize)/InputSpeed Where:

NomInverterDwellTime=the nominal dwell time in the output inverter of the first print engine;

MaxSheetSize=the maximum sheet size for a given pitch mode;

ActualSheetSize=the actual sheet size for the sheet entering the output inverter of the first print engine;

InputSpeed=the speed of the sheet entering the output inverter of the first print engine.

16. A method of controlling image to print media sheet registration in a tandem digital printing system, the method comprising:

receiving a plurality of parameters for a print job;

cycling up a first print engine and a second print engine, wherein the first print engine includes at least a first seamed photoreceptor belt and an output inverter and the second print engine includes at least a second seamed photoreceptor belt;

calculating a seam offset for the first and second photoreceptor belts, wherein the seam offset comprises an amount of time to offset the seam of the second photoreceptor belt relative to the seam of the first photoreceptor belt;

adjusting the speed of the second photoreceptor belt based on the seam offset;

starting the print job; and adjusting a dwell time of the output inverter for a given sheet length based on a maximum sheet size for a given pitch mode, actual sheet size, and the speed of the sheet entering the output inverter, wherein the dwell time of the output inverter is calculated as follows:

ActualInverterDwellTime=NomInverterDwellTime+(MaxSheetSize−ActualSheetSize)/InputSpeed Where:

NomInverterDwellTime=the nominal dwell time in the output inverter of the first print engine;

MaxSheetSize=the maximum sheet size for a given pitch mode;

ActualSheetSize=the actual sheet size for the sheet entering the output inverter of the first print engine;

InputSpeed=the speed of the sheet entering the output inverter of the first print engine.

17. A tandem digital printing system comprising:

a first print engine having a first seamed photoreceptor belt and an output inverter;

a second print engine having a first seamed photoreceptor belt; and a master controller operatively connected to the first and second print engines and the first inverter, wherein the master controller is operative to:

receive a plurality of parameters for a print job;

cycle up a first print engine and a second print engine, wherein the first print engine includes at least a first seamed photoreceptor belt and an output inverter and the second print engine includes at least a second seamed photoreceptor belt;

calculate a seam offset for the first and second photoreceptor belts, wherein the seam offset comprises an amount of time to offset the seam of the second photoreceptor belt relative to the seam of the first photoreceptor belt;

adjust the speed of the second photoreceptor belt based on the seam offset;

start the print job; and adjust a dwell time of the output inverter for a given sheet length based on a maximum sheet size for a given pitch mode, actual sheet size, and the speed of the sheet entering the output inverter, wherein the dwell time of the output inverter is calculated as follows:

$$\text{ActualInverterDwellTime}=\text{NomInverterDwellTime}+(\text{MaxSheetSize}-\text{ActualSheetSize})/\text{InputSpeed}$$

Where:

NomInverterDwellTime=the nominal dwell time in the output inverter of the first print engine;

MaxSheetSize=the maximum sheet size for a given pitch mode;

ActualSheetSize=the actual sheet size for the sheet entering the output inverter of the first print engine;

InputSpeed=the speed of the sheet entering the output inverter of the first print engine.

* * * * *